US005575615A

United States Patent [19]

Mohn

[11] Patent Number: 5,575,615

[45] Date of Patent: Nov. 19, 1996

[54] MULTIPHASE FLUID TREATMENT

[75] Inventor: Frank Mohn, London, England

[73] Assignee: Framo Developments (UK) Limited, London, United Kingdom

[21] Appl. No.: 551,315

[22] Filed: Nov. 1, 1995

Related U.S. Application Data

[62] Division of Ser. No. 256,255, filed as PCT/GB92/02403, Dec. 29, 1992.

[30] Foreign Application Priority Data

Dec. 30, 1991 [GB] United Kingdom ..... 9127474

[51] Int. Cl.[6] ..... B01D 17/00

[52] U.S. Cl. ..... 415/74; 415/91; 415/169.1; 415/169.2; 210/322; 55/457; 96/216

[58] Field of Search ..... 415/71, 74, 91, 415/169.1, 169.2; 210/322, 326, 360.1, 380.1, 380.3, 402, 403, 404; 96/204, 206–208, 213–217; 55/437, 452, 456, 457

[56] References Cited

U.S. PATENT DOCUMENTS

| | | |
|---|---|---|
| 3,435,771 | 4/1969 | Riple . |
| 3,677,659 | 7/1972 | Williams . |
| 3,936,214 | 2/1976 | Zupanick . |
| 3,942,961 | 3/1976 | Holliday et al. . |

FOREIGN PATENT DOCUMENTS

| | | | |
|---|---|---|---|
| 0437070 | 7/1991 | European Pat. Off. . | |
| 630932 | 7/1936 | Germany . | |
| 1653690 | 10/1971 | Germany . | |
| 59-158398 | 9/1984 | Japan . | |
| 237063 | 3/1945 | Switzerland . | |
| 2192230 | 1/1988 | United Kingdom . | |
| 87/03051 | 5/1987 | WIPO | 415/169.1 |
| WO91/04417 | 4/1991 | WIPO . | |

*Primary Examiner*—James Larson
*Attorney, Agent, or Firm*—Young & Thompson

[57] ABSTRACT

Apparatus for the treatment of a multiphase fluid, comprises a pretreatment stage (60) upstream of a treatment stage, the pretreatment stage being arranged to cause an incoming flow of multiphase fluid to concentrate fluids of greater and lesser specific gravity into respective flow paths for subsequent treatment in the treatment stage and the pretreatment stage comprising a cyclonic separator device (60) concentrating fluid or fluids of greater specific gravity into an outer annular flow path around an inner flow path for fluid or fluids of lesser specific gravity. The treatment stage comprises a centrifuge having a separator drum (65) rotatable about the axis (66) thereof with an inlet end portion next to the cyclonic separator device (60) comprising concentric inner and outer walls (76, 70) and helical vanes (75) between the walls. The cyclonic separator device (60) comprises radially spaced concentric sleeves with at least one helical fin disposed between the sleeves, the sleeves confining the inner and outer flow paths between them.

2 Claims, 3 Drawing Sheets

MULTIPHASE FLUID TREATMENT

This application is a division of application Ser. No. 08/256,255, filed as PCT/GB92/02403, Dec. 24, 1992, which is pending.

FIELD OF THE INVENTION

The invention relates to treatment of a multiphase fluid, for example, in a transport or separator system.

BACKGROUND OF THE INVENTION

The handling of a multiphase fluid, that is, a mixture of at least two fluids of different phases, presents problems arising for example from the different physical characteristics of liquids and gases, in particular, the virtual incompressibility of the former and the ready compressibility of the latter, and also from variations in the relative amounts of liquids and gases in the multiphase fluid. For example, in oil production, a well may produce a mixture of crude oil, crude gas, water and sand or like particulate material. It is desirable in many instances to place such a mixture under increased pressure, but this is difficult because pumps with impellers designed to pump liquid are unsuitable where the liquid contains a high gas content. Similarly, ordinary gas compressors are unsuitable for use where liquid is present in the gas in any substantial amount.

SUMMARY OF THE INVENTION

In accordance with the invention, there is provided apparatus for treatment of a multi-phase fluid, comprising an inlet stage leading to a treatment stage, the inlet stage comprising a cyclonic separator device in which the multiphase fluid is divided into separate flows consisting at least substantially of fluid of higher and lower specific gravities respectively, for at least one of further separation, pumping, and compression in the treatment stage.

The invention is accordingly concerned in one aspect with the provision of a pump/compressor unit arranged for efficient pressurising of a multiphase fluid regardless of variations in the quantities of gas or liquid in the fluid.

A pump/compressor apparatus in accordance with the invention is thus arranged for receiving an incoming multiphase fluid and directing the fluid cyclonically to effect separation of the phases, with a stream of fluid with the highest specific gravity as a layer at the outer surface of the cyclone and a stream of fluid with the lowest specific gravity in the centre of the cyclone. The incoming fluids with the highest specific gravity are then directed into a helical path at the outer periphery of the apparatus along which energy is added by means of rotating impeller guide vane passages increasing the rotational velocity of the fluid, and thus the pressure. The incoming fluids with the lowest specific gravity are similarly acted upon by a rotating impeller means, preferably providing for compression of the fluids which will typically comprise gaseous material.

The invention thus provides a pump/compressor unit having an inlet for a multiphase fluid, means for separating the fluid into its components and for pressurising the components by respective impeller means. Preferably the two impeller means are parts of a single impeller assembly.

The impeller assembly can thus provide an interior defining a first flow path along which the gaseous or lower specific gravity fluids are directed along the impeller assembly axis and then transported radially by blades or vanes.

The cross-sectional area of the flow path preferably reduces progressively in the flow direction, so as to enhance compression of the fluid. The compressed fluid of the first stream can then be discharged from around the impeller assembly periphery.

Radially adjacent of the first flow path, a second flow path is provided for the higher specific gravity or liquid stream, between the exterior of the assembly and a housing within which the assembly rotates. The second path again effects axial re-direction of the stream, into an annular trough or channel from which the liquid is accelerated by impeller means to an outlet by way of a fluid pick-up or scoop device.

Such a pump/compressor device would be self-regulating, and also self-priming because gas would not have to be drained out before pumping could commence. The device would itself act as a fluid lock, because it would never empty completely, so preventing gas from blowing back from the gas outlet in the absence of incoming liquid. Also, gas lock is prevented, so non-functioning cannot result from intolerance of an essentially gaseous input.

Alternatively, the invention can be embodied in a centrifugal separator apparatus for separating the components of a multiphase fluid, the apparatus having an inlet stage similar to that described above for providing the separate flows. The fluid flows at the outlet of the helical path are directed into a rotating separator. The or each fluid flow with the highest specific gravity is directed into an impeller stage with passages defined by guide vanes with or without an inner wall. The liquid layers then proceed axially along the inner surface of the separator cylinder or drum and are discharged therefrom in any suitable way as by reception in a discharge chamber into which a discharge scoop extends. The gaseous component of the multiphase fluid is also brought into rotation by the guide vanes and proceeds axially through the separator drum. Any liquid drops remaining will be separated from the gas by centrifugal force and the dry gas can be withdrawn from the separator without further pressure increase.

In operation, the incoming fluid is efficiently brought to full rotational speed, without turbulence in the outlet, and with improved separation. By selecting appropriate average outlet cross-sectional areas from the impeller, improved separation efficiency can be obtained because the average momentum of the fluid in the outlet can be made equal to the average momentum of fluid in the separator phase.

BRIEF DESCRIPTION OF THE DRAWING

The invention is further described below, by way of example, with reference to the accompanying drawings, in which.

DETAILED OF THE INVENTION

Figure 1:
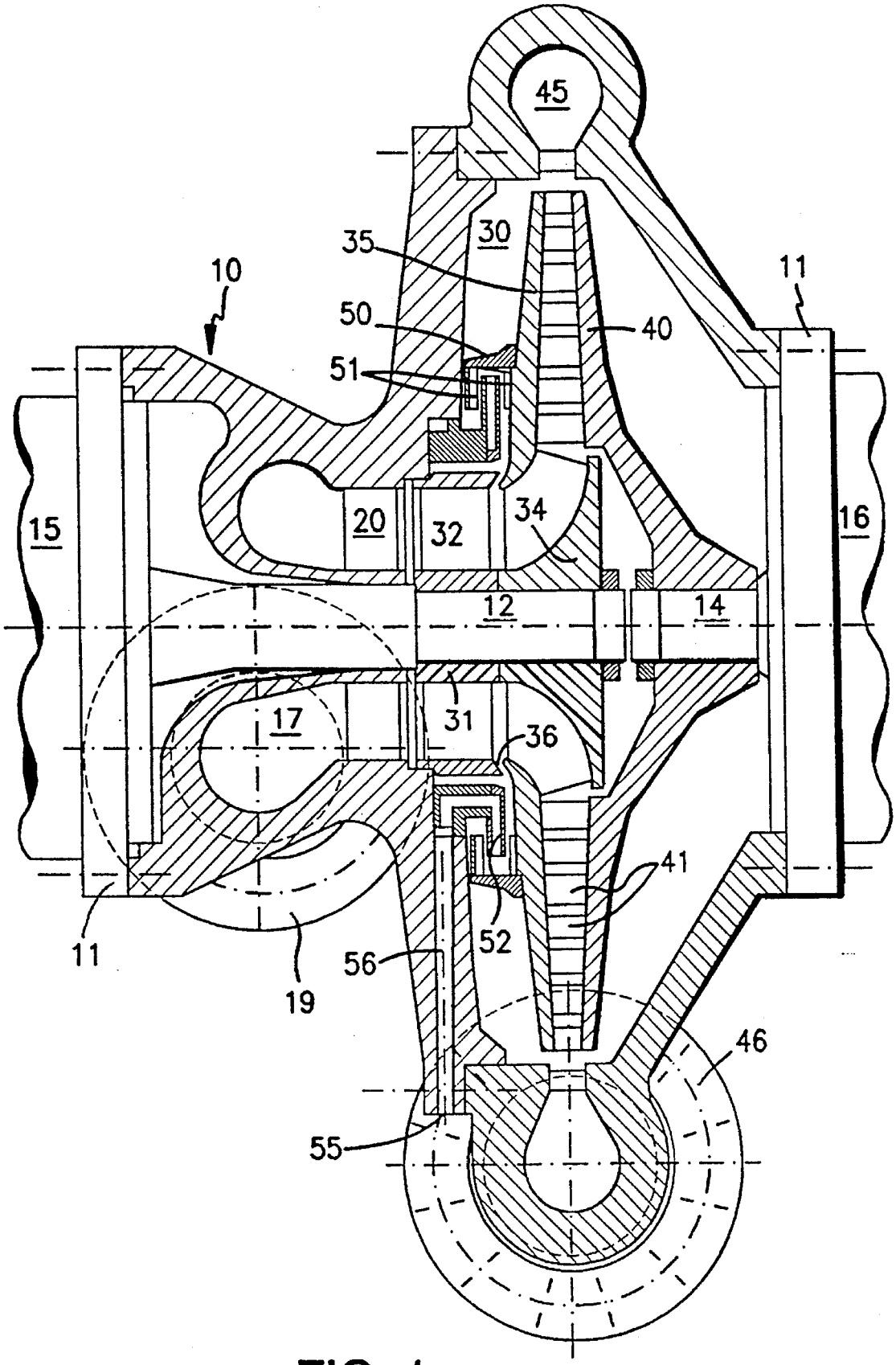
FIG. 1 is a schematic cross-sectional side view of a pump/compressor unit embodying the invention.

The pump/compressor unit illustrated in FIG. 1 comprises a stationary casing 10 having axially opposed open ends closed by end plates 11 through apertures in which respective drive shafts 12 and 14 extend along a common axis from respective electric drive motors 15 and 16. At the lefthand end (as shown) an inlet chamber 17 in the form of a volute is provided within the casing around its axis and into which a multiphase fluid is introduced in use from outside by means of an inlet fitting 19.

Figure 2:
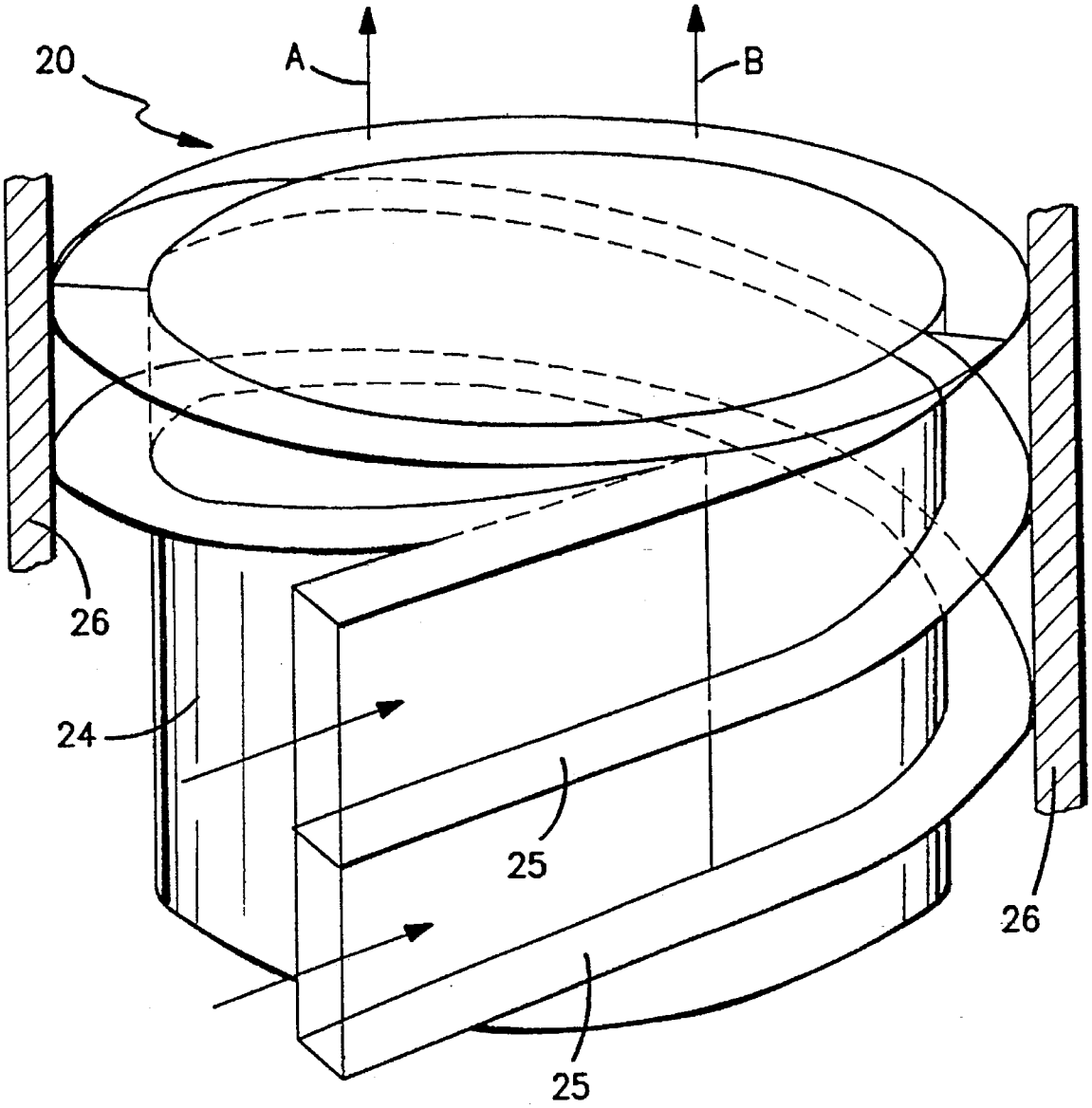
FIG. 2 is a perspective view of a cyclonic inlet stage of the unit of FIG. 1.

The incoming mixture has a rotational movement imposed on it by the shape of the inlet chamber 17 and this movement is enhanced in the next stage by a fixed guide member 20, shown in FIG. 2, received in an annular chamber communicating with the inlet chamber and into which the fluid moves in the axial direction. The guide member 20 comprises an inner sleeve 24 with external fins 25 defining with the inner wall 26 of the casing 10 plural helical channels for the multiphase fluid. The centrifugal force generated by the rotary movement of the fluid causes the heavier fluid or fluids, that is, the liquid component of the mixture, to concentrate into an annular flow path A against the casing wall 26 whilst the less dense gaseous component occupies a flow path B at the inner region of the channels. The multiphase fluid is thus cyclonically separated into concentric layers of increasing density in the radially outward direction.

Continuing the axial flow direction, the interior of the casing 10 next has a radially enlarged portion 30 constituting pump/compressor stage. Carried on the free end of the shaft 12 is a first part of an impeller assembly comprising concentric inner and outer sleeves 31 and 32 providing between them an annular passage continuing the annular space between the sleeve 24 and the inner wall 26. Axially adjacent the inner sleeve 31 is a member 34 which flares radially outwardly in the flow direction, so as to re-direct the primarily gaseous fluid stream adjacent the inner sleeve 31 along a radially outward direction. The impeller assembly part on the shaft 12 also comprises an annular disc 35, extending generally radially outwardly from a position near to, but spaced from, the downstream end of the outer sleeve 32, so as to form therewith an annular passage 36 through which can flow the outer layer of the fluid, comprising the denser, liquid, phase. The inner edge of the disc 35 thus separates the inner and outer layers, typically of gaseous and liquid components respectively, formed in the multiphase fluid by the centrifugal force generated upstream.

The free end of the shaft 14 carries a second part of the impeller assembly comprising an annular disc 40 extending generally radially outwardly to oppose the disc 35. Each disc carries impeller vanes or blades 41 extending towards the other disc. The shafts 12 and 14 are driven by the motors 15, 16 so as to rotate in opposite directions and the blades 41 are shaped to urge the gaseous stream directed to them by the member 44 to flow radially outwardly. The opposed faces of the discs 35 and 40 slightly converge in the radially outward direction so as to restrict the flow passage between them. The gaseous stream is thus compressed in its passage between the discs 35 and 36 and it flows outwardly from between them into a discharge chamber 45 in the form of a volute provided in the casing 10 around the outer edges of the discs. A discharge fitting 46 communicates with the chamber 45 to conduct the compressed gaseous flow outwardly of the unit.

The more dense, primarily liquid, stream flowing radially outwardly through the passage 36 between the sleeve 32 and the disc 35, at the side of the disc remote from the disc 40, is received in an annular channel formed by a member 50 secured to the disc 35 and comprising a concentric sleeve portion having at its free end an annular rim portion directed inwardly towards the shaft 12. Within the channel, impeller vanes or blades 51 on the disc 35 and the rim portion effect acceleration of the liquid. The liquid is extracted from this channel by a stationary scoop 52 comprising spaced disc portions extending outwardly into the channel of the member 50 and providing passages for radially inward flow of the liquid from the channel. This discharge flow continues axially through a support portion projecting from an adjacent wall portion of the casing 10, and to a discharge outlet 55 by way of a passage 56 in the wall portion.

The pump/compressor unit described and illustrated thus provides for the separation, and separate treatment, of the gas and liquid components of the incoming multiphase fluid, so that each can be pressurised by impeller means appropriate to the characteristics of the component which it handles.

The separation of the gas and liquid stream can of course be maintained downstream of the unit if appropriate, but if the function of the unit is simply to effect transport of the multiphase fluid, the separate gas and liquid outputs can be combined for flow for example along a pipeline to equipment in which the fluid is subsequently treated.

Figure 3:
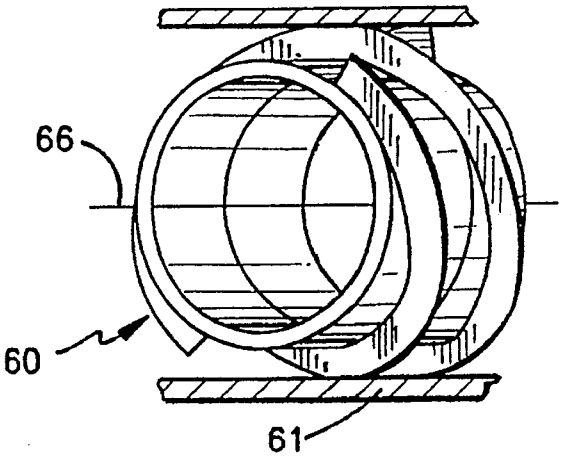
FIGS. 3 and 4 are perspective, part sectional, views, from different viewpoints, respectively of a cyclonic inlet stage and of the inlet end of a rotary stage, of a centrifugal separator apparatus embodying the invention.
Figure 4:
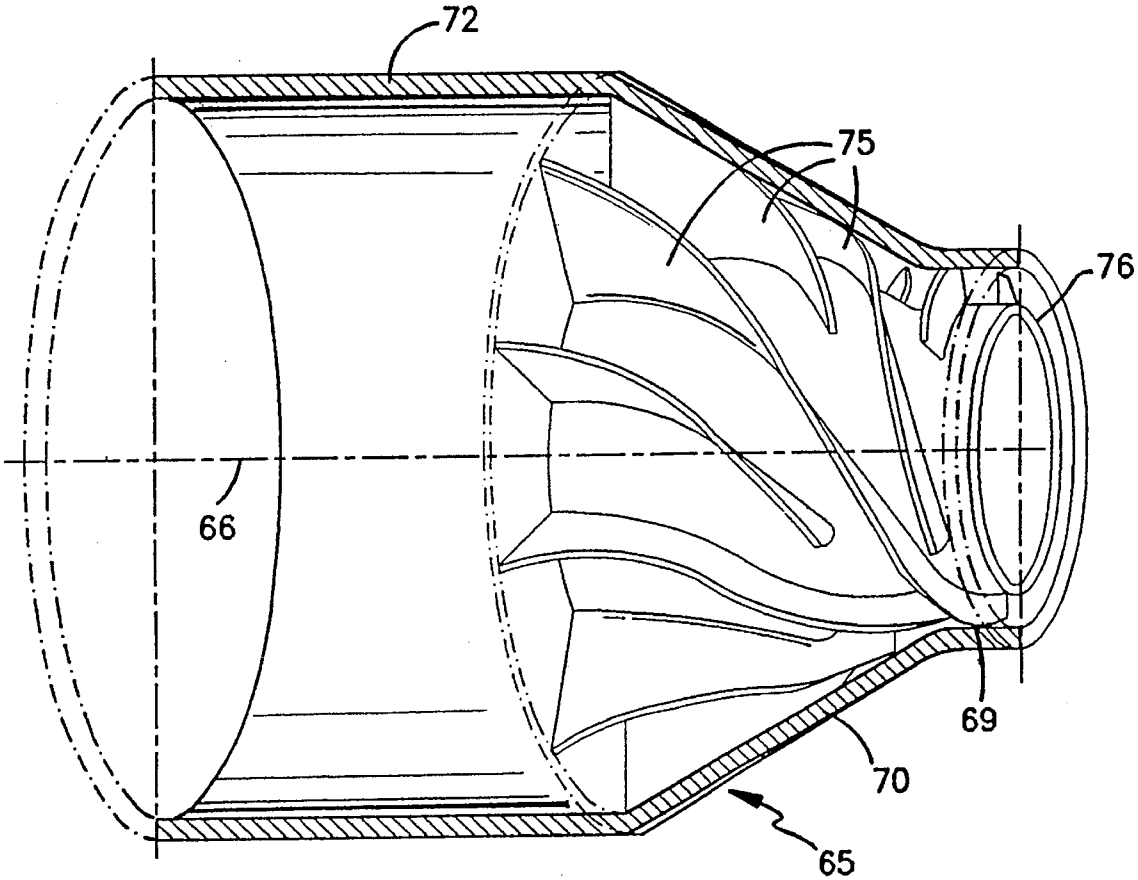

The centrifugal separator apparatus of FIGS. 3 and 4 has a stationary inlet stage largely corresponding in design and function to that of the pump/compressor unit of FIGS. 1 and 2. The inlet stage thus includes a stationary guide member 60 as shown in FIG. 3 which may be closely similar to the guide member 20 of FIG. 2 and which again serves to cause an incoming multiphase fluid to form into an axially flowing stream of material of higher specific gravity, typically one or more liquid layers, confined by a housing wall 61, and an inner stream of material of lower specific gravity, typically of a gaseous nature.

From the stationary inlet stage of the apparatus, the concentric fluid streams enter a rotary impeller/separator stage, of which the inlet end only is shown in FIG. 4. This part of the apparatus comprises a drum 65 which is rotated in use by a motor (not shown) about its axis 66. The drum wall at its inlet end has a short portion 69, with a diameter matched to that of the guide member 60, followed downstream by a frusto-conical portion 70 leading to a separator drum portion 72 of constant larger diameter. The inlet and frusto-conical wall portions mount a series of impeller vanes 75 extending inwardly preferably but not necessarily, to a concentric inner sleeve 76 of a diameter equal to that of the sleeve of the guide member 60.

The impeller vanes 75 receive the fluids flowing concentrically in the helical paths imposed by the guide member 60 and act to increase the rotational speed of the fluids in the frusto-conical portion 70. The fluid layers then flow from the passages defined by the frustoconical portion 70, the vanes 75 and the sleeve 76, to flow along the drum portion 72 where further separation occurs by conventional centrifugal separator action. Any liquid in the central gaseous flow joins the outer liquid layer (or layers where there are two liquids of different specific gravities). The liquid or liquids can be removed from the drum by conventional means or the centrifuge can be designed to be self-regulating as described in Application GB 91 26 415.0, the contents of which are incorporated herein by reference. The gas can be discharged from the drum through appropriately located apertures (not shown).

The invention can of course be carried into effect in a variety of ways other than as specifically described and illustrated.

I claim:

1. In an apparatus for the treatment of a multiphase fluid, the apparatus comprising a pretreatment stage (60) upstream of a treatment stage, the pretreatment stage being arranged to cause an incoming flow of multiphase fluid to concentrate fluids of greater and lesser specific gravity into respective flow paths for subsequent treatment in the treatment stage and the pretreatment stage comprising a cyclonic separator device (60) concentrating fluid or fluids of greater specific gravity into an outer annular flow path around an inner flow path for fluid or fluids of lesser specific gravity; the improvement wherein the treatment stage comprises a centrifuge having a separator drum (65) rotatable about the axis (66) thereof with an inlet end portion next to said cyclonic separator device (60) comprising concentric inner and outer walls (76, 70) and helical vanes (75) between the walls.

2. An apparatus as claimed in claim 1, wherein said cyclonic separator device (60) comprises radially spaced concentric sleeves with at least one helical fin disposed between the sleeves, the sleeves confining the inner and outer flow paths between them.

* * * * *